United States Patent [19]

Nerrinck

[11] Patent Number: 4,754,560

[45] Date of Patent: Jul. 5, 1988

[54] DEVICE FOR SECURING A SKIER'S FOOT INSIDE A SKI BOOT

[75] Inventor: Bernard Nerrinck, La Balme de Sillingy, France

[73] Assignee: Salomon S.A., Annecy Cedex, France

[21] Appl. No.: 929,446

[22] Filed: Nov. 12, 1986

[30] Foreign Application Priority Data

Nov. 12, 1985 [FR] France ..... 85 16681

[51] Int. Cl.[4] ..... A43B 5/04

[52] U.S. Cl. ..... 36/119; 36/50; 24/68 SK

[58] Field of Search ..... 36/117–121, 36/50, 105; 24/68 SK

[56] References Cited

U.S. PATENT DOCUMENTS 3,834,048 9/1974 Maijrer ..... 36/50

FOREIGN PATENT DOCUMENTS 3524792 1/1986 Fed. Rep. of Germany ..... 36/119

3506057 2/1986 Fed. Rep. of Germany ..... 36/117

*Primary Examiner*—James Kee Chi

*Attorney, Agent, or Firm*—Pollock, Vande Sande & Priddy

[57] ABSTRACT

A flexible interior element (7) for securing the foot of a skier inside a rear entry ski boot. The respective ends of the element are attached at two spaced points (8, 9) on the rear portion (4) of the upper, and form between these ends a loop which passes over a return element (15), which is displaceable by a tension adjuster so as to vary the length and hence the tension of the loop.

9 Claims, 1 Drawing Sheet

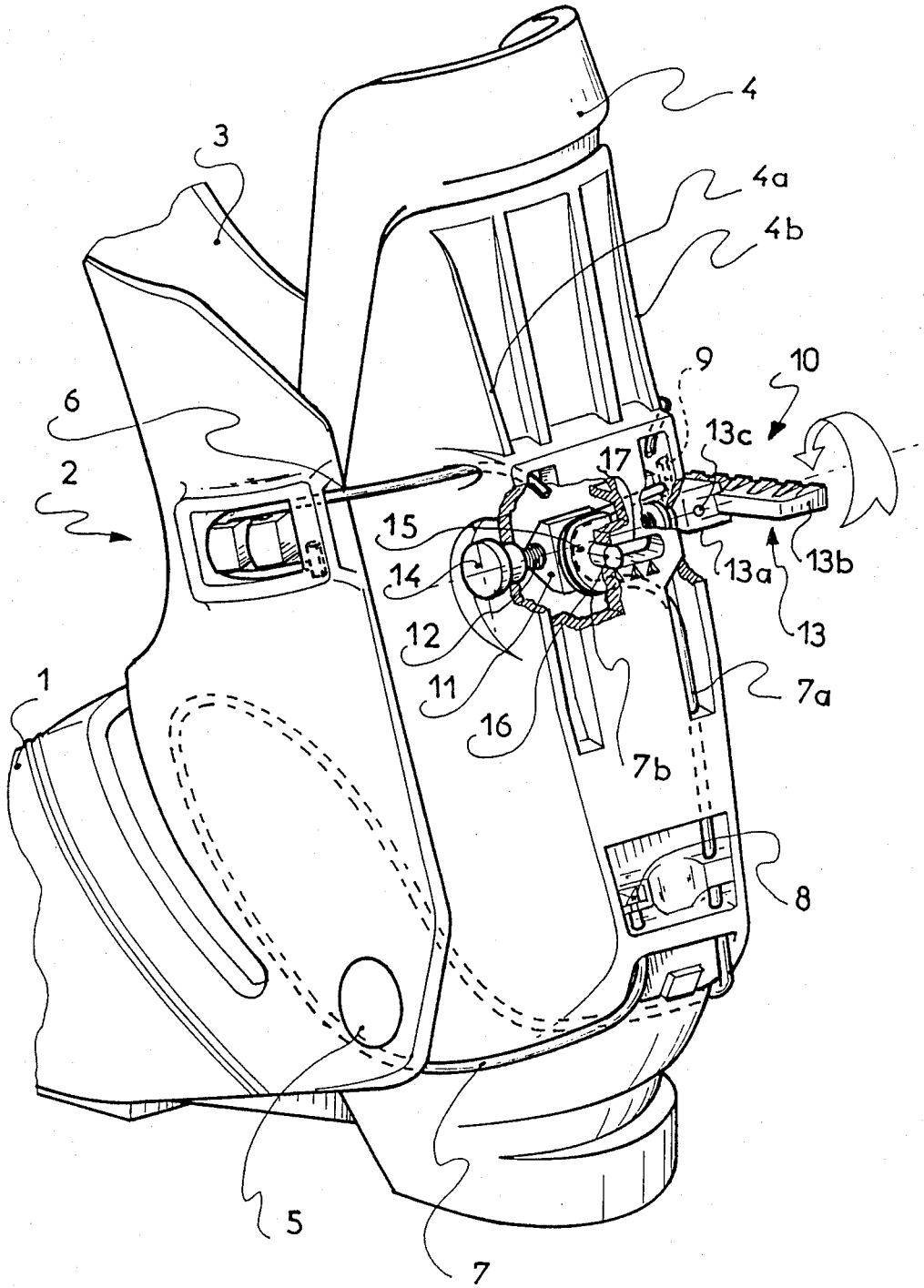
4
3
4a
4b
9
10
6
13c
17
2
15
13a
13b
14
13
12
11
7a
1
16
7b
8
5
7

DEVICE FOR SECURING A SKIER'S FOOT INSIDE A SKI BOOT

FIELD OF THE INVENTION

The present invention relates to a device for securing the foot of a skier inside a rear entry ski boot.

BACKGROUND OF THE INVENTION

Ski boots comprising a shell base on which is mounted an upper having front and rear portions surrounding the skier's leg are known in the art. The rear portion of the upper is articulated on the shell about a lower transverse axis, so as to pivot to the rear, thereby creating an opening sufficient for entry of the skier's foot through the rear of the boot.

Such ski boots are provided with a flexible element, such as a cable, for tightening the front and rear portions against one another, so as to enclose the lower part of the skier's leg firmly in the boot. A second flexible tightening element is engaged at the interior of the boot and passes above the instep of the skier's foot so as to press the foot downwardly and rearwardly when the element is tightened. This second element hence assures tightening of the foot in the region called "short perimeter of the heel."

In known rear entry boots, the internal tightening element constitutes a completely closed buckle connected to an adjusting mechanism mounted on the outside of the boot, at the back of the rear portion of the upper, for the purpose of enabling the tightening element to be placed under traction once the foot is inside the boot. A device is provided for adjusting the tension of the element according to the requirements of the skier.

A ski boot of this type has the disadvantage that, because the internal tightening element forms a closed buckle, it requires, for its utilization, the uncomfortable and burdensome operation of crimping tubes on the two free ends portions of the cable constituting the tightening element. Moreover, in order to adjust the tension or tightening element of such boots, it is necessary to pull down the operating lever so as to gain access to the adjusting means; this manipulation is not always easy for all types of skiers.

SUMMARY OF THE INVENTION

The present invention therefore concerns improvements to a rear entry ski boot designed to simplify the operation of the internal tightening element and the device for adjusting its tension. It is characterized by the fact that the internal tightening element is attached at its two ends at two points, distant from one another, on the rear portion of the upper, and forms, in an intermediate portion, a loop passing over a return element, means being provided for displacing this return element so as to vary the length of the loop formed by the flexible tightening element, and hence the tension thereof.

The ski boot according to the invention offers the advantage that the mounting of the cable constituting the internal tightening element does not require crimping of metallic tubing on the ends of the cable for forming a closed loop. Besides, the number of different cable lengths required for taking account of the range of boot sizes is significantly reduced.

Preferably, the device for adjusting the tension of the internal tightening element comprises, at its end, an operating knob pivotably mounted so as to be pulled down along the upper once the desired degree of tension is attained, the operating knob then being protected under the bottom of the skier's pants.

The device for adjusting the tension of the internal tightening element may also advantageously be provided with means enabling display of the amount of adjustment, i.e., each level of tensioning. This device does not inconvenience the skier at all when he walks with the boot in open or untightened position. The operation is also very simple, since it does not comprise a mechanism of the toggle joint type, as in the case of known devices. Moreover, the internal flexible tightening elements are not limited to cables; it is easy to conceive that they might comprise a strap portion in the region applied against the instep, the end portions of the strap being connected to cable portions in turn attached to the two spaced anchoring points on the rear portion of the upper.

BRIEF DESCRIPTION OF THE DRAWING

In order that the invention may be more clearly understood, an exemplary embodiment thereof will now be described with reference to the single drawing FIGURE, which shows in perspective view a rear entry boot provided with a device for adjusting the tension of an internal flexible tightening element, according to the invention.

DETAILED DESCRIPTION

The ski boot shown in the drawing is of the rear entry type and comprises, in the conventional manner, a shell base 1 and an upper 2 constituted by two portions, i.e., a front portion 3 and a rear portion 4, the latter being articulated on the shell base about a low horizontal and transverse axis 5.

The ski boot further comprises two flexible tightening elements, such as cables, including a cable 6 for tightening the lower portion of the skier's leg and an internal cable 7 for securing the skier's foot in the region of the short perimeter of the heel. The latter cable is attached at one of its ends (8) to a point on the rear portion 4 of the upper 2, e.g., in the lower region thereof. The other end (9) of the cable 7 is also attached to the rear portion 4 of the upper, but in the upper region thereof where there is located a device 10 for adjusting the tension of cable 7. Preferably, the anchoring points of the two ends 8 and 9 of cable 7 are respectively located on both sides of a longitudinal median plane of the rear portion 4 of the upper.

The device 10 for adjusting the tension of cable 7 comprises a slide 11 which is movable horizontally and transversely under the control of a horizontal, transverse screw 12 extending through it and screwed into threading provided in slide 11. This adjusting screw 12 is rotatably mounted on the rear portion 4 of the upper, e.g., passing through holes in vertical ribs **4*a*, 4*b*, projecting rearwardly from said rear portion. Screw 12 is solid at one of its ends (in the drawing at its right hand end) with a control knob 13. This knob is preferably of the pull-down type and comprises a base 13*a*, rigidly solid with the right end of the adjusting screw which projects to the outside, toward the right, with respect to the right hand rib 4*b*, and a hand lever 13*b* pivoting on base 13*a* about an axis 13*c*. At its other end, i.e., at the left hand end as seen in the drawing, screw 12 is solid with a journal 14 which is rotatably mounted in a hole forming a bearing provided in left hand vertical rib 4*a***.

Slide 11 is solid with a return element 15 which may be constituted by a semi-circular neck or a necked half-pulley located to the left of the vertical plane containing the diameter limiting the neck. This return element is extended toward the rear by a finger 16 engaged in a guide slot 17 extending horizontally and transversely, this guide slot being formed in the outer face of the rear portion 4 of the upper. As will be clear from the drawing, the vertical end which extends in the direction of the upper end of cable 7 forms, about the return element 15, a loop *7b* extending horizontally and transversely while opening to the right, assuming that the upper end 9 of cable 7 is attached to the right hand portion of rear portion 4.

It will be understood that, in order to adjust the tension of tightening element 7, it suffices to cause adjusting screw 12 to turn, by means of operating knob 13, causing horizontal and transverse displacement of slide 11 and return element 15, such displacement in turn causing variation in the length of loop *7b* and tension of varying strength on tightening element 7.

Adjusting device 10 may comprise means for marking the tension obtained for each position of slide 11. For example, the relative position of finger 16 in guide slot 17 may be used for this purpose, with a scale.

While in the preceding description adjusting device 10 has been described as extending horizontally and transversely, it can clearly occupy a different position, e.g., vertical or intermediate between a horizontal, transverse position and a vertical one.

What is claimed is:

1. In a rear entry ski boot comprising a shell base on which is mounted an upper having front and rear portions surrounding the lower part of the leg of a skier, said rear portion being articulated on said shell base about a transverse low axis, the improvement comprising (a) a flexible interior element (7) for securing a foot of said skier in the region of the short perimeter of the heel of said foot, said element being engaged inside said boot and passing above the instep of said foot so as to press said foot downwardly and rearwardly; and (b) a device (10) mounted at the exterior of said boot on the back of said rear portion (4) of said upper, for adjusting the tension of said flexible element;

(c) said flexible element (7) being attached at its two ends to two points (8, 9) of said rear portion (4) distant from one another, and forming between said two points a loop (*7b*) passing over a return element (15);

(d) means (10) being provided for displacing said return element (15) such as to vary the length of said loop (*7b*) and hence its tension;

(e) wherein said displacement means (10) comprise a slide (11) whose movement is controlled by a screw (12) extending therethrough and screwed in threading provided in said slide, said screw being rotatably mounted on said rear portion (4) of said upper and being solid, at one of its ends, with an operating knob (13).

2. The combination according to claim 1, wherein said operating knob (13) is of the pull-down type and comprises a base (13*a*) rigidly fixed to said one end of said knob and a hand lever (13*b*) pivotable on said base about an axle (13*c*).

3. The combination according to claim 2, wherein said screw (13), at the end thereof opposite to that which carries said operating knob (13), is solid with a journal (14) rotatably mounted in a hole forming a bearing provided in an element projecting from said rear portion of said upper.

4. The combination according to claim 1, wherein said return element (15) is extended toward the rear of said boot by a finger (16) engaged in a guide slot (17) which is formed in an outer face of said rear portion (4) of said upper.

5. The combination according to claim 4, wherein said guide slot (17) carries, along one of its edges, a graduated scale for displaying the tension of said securing element as a function of the position of said finger (16) in said slot (17).

6. The combination according to claim 1, wherein said screw (12) controlling the movement of said slide (11) extends horizontally and transversely of said boot.

7. The combination according to claim 6, wherein said scew (12) traverses holes provided in vertical ribs (*4a, 4b*) projecting rearwardly from said rear portion (4) of said upper, said screw being solid, at one of its ends, with a journal (14) rotatably mounted in a hole forming a bearing provided in one of said vertical ribs (*4a*), and being solid with said operating knob (13) at its other end projecting to the outside with respect to another (*4b*) of said ribs.

8. The combination according to claim 1, wherein said attachment points (8, 9) of said flexible element (7) are respectively located on both sides of a longitudinal median plane of said rear portion (4) of said upper.

9. The combination according to claim 1, wherein said return element (15) is constituted by a necked half-pulley in which said loop (*7b*) travels.

* * * * *